United States Patent [19]

Warren et al.

[11] 4,397,426

[45] Aug. 9, 1983

[54] SHOE BRACKET ASSEMBLY FOR VERTICAL SHAFT IMPACT CRUSHING MACHINES

[75] Inventors: Donald R. Warren, Milwaukie, Oreg.; Kenneth D. Warren, Spokane, Wash.

[73] Assignee: Spokane Crusher Mfg. Co., Spokane, Wash.

[21] Appl. No.: 261,379

[22] Filed: May 7, 1981

[51] Int. Cl.[3] ..... B02C 13/09

[52] U.S. Cl. ..... 241/275; 51/435

[58] Field of Search ..... 241/275; 51/435

[56] References Cited

U.S. PATENT DOCUMENTS

| | | | |
|---|---|---|---|
| 3,074,657 | 1/1963 | Bridgewater | 241/275 X |
| 3,088,685 | 5/1963 | Bridgewater | 241/275 |
| 3,110,449 | 11/1963 | Bridgewater | 241/275 X |
| 3,149,793 | 9/1964 | Bridgewater | 241/275 |
| 3,474,974 | 10/1969 | Wood | 241/275 |
| 4,174,814 | 11/1979 | Warren et al. | 241/275 |
| 4,326,676 | 4/1982 | Rose | 241/275 |
| 4,355,769 | 10/1982 | Warren et al. | 241/275 X |

*Primary Examiner*—Howard N. Goldberg

*Attorney, Agent, or Firm*—Wells, St. John & Roberts

[57] ABSTRACT

A shoe bracket assembly is described for mounting an impeller shoe to the horizontal rotatable turntable of a vertical shaft centrifugal crushing machine. The shoe bracket includes removable wear protector plates on opposed end faces thereof. The plates protect the rigid base member of the bracket assembly against wear. The wear plates are slidably mounted to the base member by slidable dovetail connector members and are locked into place between abutment surfaces on the base member and a back face surface of the impeller shoe. The plates can be easily removed and replaced following removal of the impeller shoe.

9 Claims, 9 Drawing Figures

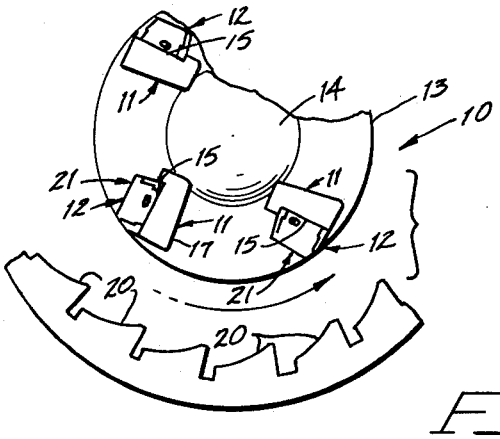
Fig 1
Fig 2
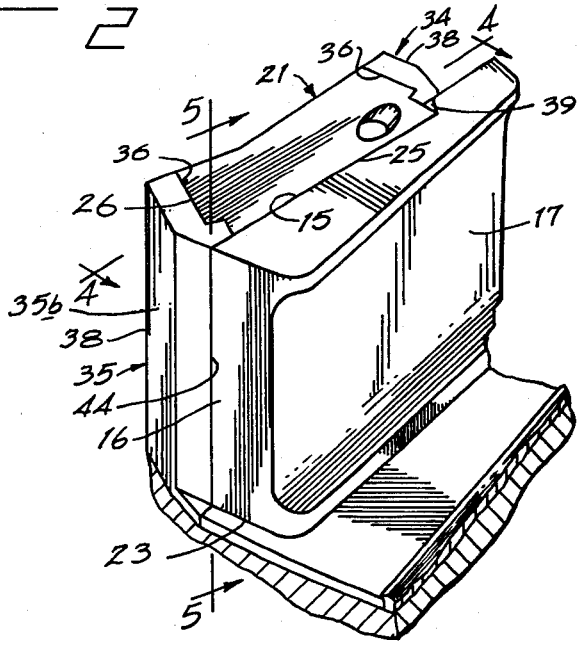

SHOE BRACKET ASSEMBLY FOR VERTICAL SHAFT IMPACT CRUSHING MACHINES

TECHNICAL FIELD

This invention relates to a vertical shaft centrifugal impact crushing machine and more particularly to shoe bracket assemblies for mounting impeller shoes to such machines.

BACKGROUND OF THE INVENTION

In vertical shaft centrifugal impact crushing machines, bulk particulate material is fed centrally onto a horizontal turntable. The turntable is rotated about a vertical axis at high speed. Impeller shoes are mounted on the turntable to engage and thrust the particulate material at high velocity radially outward from the central portion of the turntable. The outwardly moving particles impact against stationary-wear resistant anvil members positioned about the periphery of the turntable. When the material strikes the anvil members, instantaneous deceleration forces cause the material to break into smaller pieces.

The impellers are subject to considerable wear due to the constant frictional engagement with the particles. They are therefore preferably made to be easily removed from the turntable. Upright brackets are typically provided to releasably mount the impeller shoes at equal angular locations about the turntable. The brackets must be rigidly fixed to the turntable in order to withstand centrifugal forces applied by the impeller shoes and by the particulate material impacting against the shoes. The brackets are therefore difficult to remove from the turntable.

Material leaving the turntable to engage the impact shoes does not always strike the shoes first. Some particles will inevitably strike against the brackets. The brackets experience wear along with the impeller shoes. It is desirable to provide some form of bracket that can be protected against excessive wear.

One of the principal purposes of this invention is to provide a shoe bracket assembly with a greatly increased useful life.

A further object is to provide a shoe bracket in which the areas susceptible to wear are removable, thereby avoiding the necessity of periodically removing the entire shoe bracket assembly for replacement.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which:

FIG. 1 is a diagrammatic plan view of the present shoe bracket assemblies mounted to a vertical shaft impact crushing machine;

FIG. 2 is a pictorial detail view of members of the present assembly with an impact shoe mounted thereto;

DETAILED DESCRIPTION OF A PREFERRED EMBODIMENT

Figure 3:
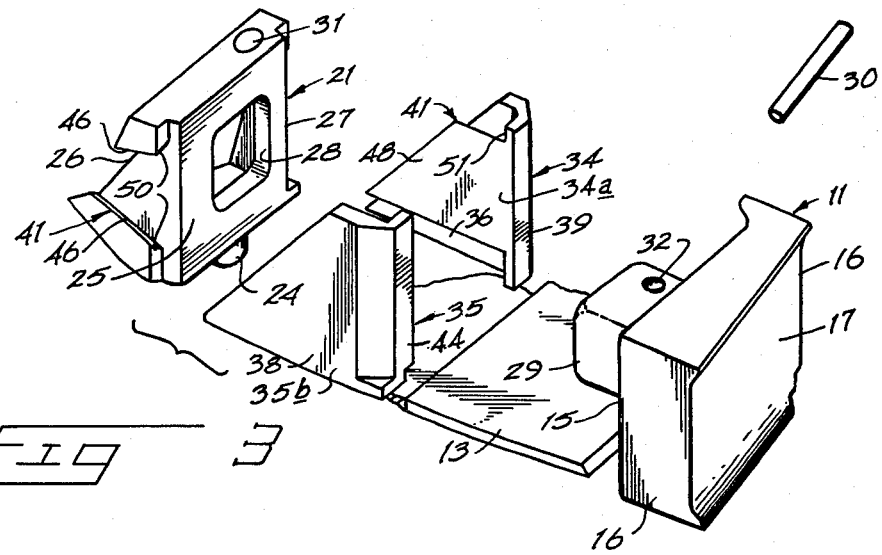
FIG. 3 is an exploded pictorial view of the present assembly, along with a portion of a turntable and an impeller shoe.
Figure 4:
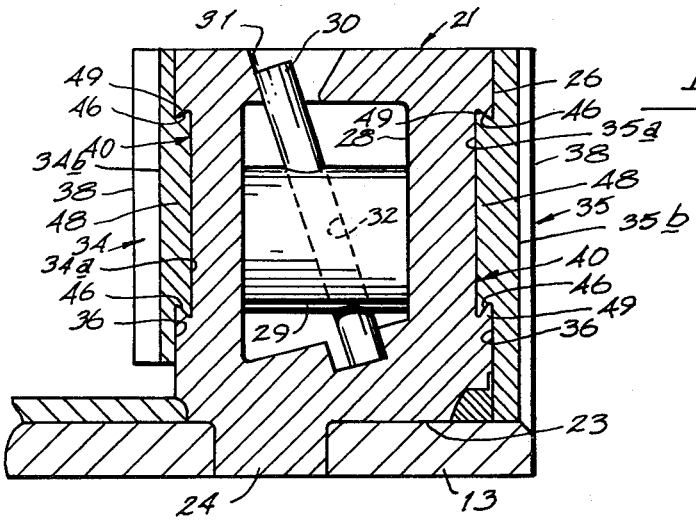
FIG. 4 is a vertical cross-sectional view taken substantially along line 4—4 in FIG. 2.

Referring now in detail to the drawings, there is illustrated in FIG. 1 a vertical shaft centrifugal impact crushing machine designated with the numeral 10. A more detailed example of such a machine is illustrated in U.S. Pat. No. 3,606,182 granted to D. R. Warren on Sept. 20, 1971. The machine is used primarily for crushing rock or other hard particulates by impacting the particulates against a stationary surface. The material is delivered onto a rotating turntable 13 which throws the material radially against stationary anvils 20.

FIG. 1 shows several impeller shoes 11 mounted to the table by the present bracket assemblies generally shown at 12. The present bracket assemblies 12 mount the shoes 11 in radial orientations at angularly spaced locations on the turntable assembly 13.

The assembly 13 also includes a central distribution disc 14 that is adapted to receive particulate material from an overhead feed (not shown). The disc 14 distributes material radially outward to the impeller shoe assemblies 11 in response to rotation about a vertical shaft axis.

The shoes 11 are removably mounted to the present bracket assemblies 12 in order to facilitate replacement for wear. For purposes of later description, each shoe will include a back face 15 and spaced upright side edges 16 extending from the back face 15 to a front face 17.

As the turntable assembly is rotated at a high speed, the material received from the disc is accelerated radially. The material leaves the rotating disc to strike the impeller shoes 11 with some also striking against the present shoe mounting bracket assemblies 12. Most of the material distributed by the disc is received along the impeller shoes 11. The shoes 11 further accelerate the material outwardly against anvil members 20 where it breaks on impact and drops down for further processing.

The material striking the bracket assemblies 12 or spilling over the sides of the impeller shoes is deflected into the paths of the next successive shoes 11. The deflected material causes wear as it moves frictionally across the engaged surfaces of the brackets.

Material leaving the shoes 11 after striking the anvil assemblies 20 will usually fall to a receiving area below. Some material, however, will rebound back against the bracket assemblies 11, causing additional bracket wear.

One of the present bracket assemblies 12 is shown in substantial detail in FIGS. 2 through 9. The individual assemblies are substantially identical, including a base or bracket member 21 that is rigidly attached to the turntable 13. Each base member 21 includes a horizontal bottom face 23 and a downwardly protruding mounting stud 24. The stud 24 is received through an appropriate aperture in the table 13 to position the base angularly and radially in relation to the central axis of the turntable. The base members 21 can be affixed to the turntable by welding or other conventional means for secure attachment. It is important that the base members 21 be rigidly secured to the table in order to withstand impact of the particulate material and the high centrifugal forces exerted by the mass of the impeller shoe assemblies 11 attached thereto.

Each base member 21 includes a substantially planar front face 25 that is complementary to the back face 15 of the associated impeller shoe. The front faces 25 are upright, preferably forming right angles with the horizontal surface of the turntable 13.

The front face 25 of each base member 21 is bordered by an outside end face 26 and a radially spaced inside end face 27 (with respect to the table axis). The end faces 26, 27 are upright and slightly inclined to one another.

Each base member also includes a mounting aperture 28 (FIGS. 3 and 4) situated intermediate the end faces 26 and 27. The aperture is formed through the front face 25 to receive a mounting stud 29 of the associated impeller shoe 11. A pin 30 may be placed through appropriate holes 31 in the base member and a hole 32 in the stud to secure the shoe 11 in place. The pin 30 holds the shoe 11 securely, with the back face 15 of the shoe bearing against the front face 25 of the base member (see FIGS. 1, 2 and 5).

Wear protector plates 34 and 35 are removably mounted to the base members 21 to present removable and replaceable wear surfaces along the base member covering areas that would otherwise be exposed to substantial wear from impact and frictional engagement with the particulate material.

The wear protector plates are shown mounted to a base member 21 in FIG. 2. An inside wear protector plate 34 is mounted to the inside end face 27 of the base member. An outer wear protector plate 35 is mounted to the outside surface 26.

Each inside wear protector plate 34 includes an inwardly facing wear surface **34*a* and an opposed outwardly facing surface 34*b*. The surface 34*b* mounts directly to the bracket base 21 along the inside end face 27**.

Each outside wear protector 35 includes an outwardly facing wear surface **35*a* and an inwardly facing bearing surface 35*b*. Bearing surface 35*b* mounts to the outside end face 26 of base member 21**.

The dimensions between the respective surfaces **34*a* and 34*b*, and surfaces 35*a* and 35*b* are the "thickness" dimensions of the plates. These dimensions are substantially equal to or slightly less than the distances the impeller shoe ends project beyond the base and faces 26 and 27**.

Each inside wear protector plate 34 includes a forward end face 39. The end face 39 will preferably fit flush against the back face 15 of an associated impeller shoe 11 when the plate is properly mounted to the base member 21 (see FIG. 2). Each outside wear protector plate 35 includes a forward end face 44 that also fits against the shoe back face 15.

Means is provided at 40 (see FIGS. 4 and 5) for removably mounting the plates 34, 35 to the base members 21. The means 40 is also adapted to position the forward end faces 39, 44 of the wear protector plates 34, 35 directly behind the parts of impeller shoes 11 that extend beyond the base member end faces 26 and 27.

The means 40 is preferably provided in the form of dovetail connector members 41 (FIGS. 4–9) on the various base members and associated wear protector plates. The dovetail connector members 41 allow the plates 34, 35 to be slidably interfitted with the base members 21 in such a manner that the plates will be secure to the base members when in use and can also be readily removed and replaced after eventual wear.

Figure 5:
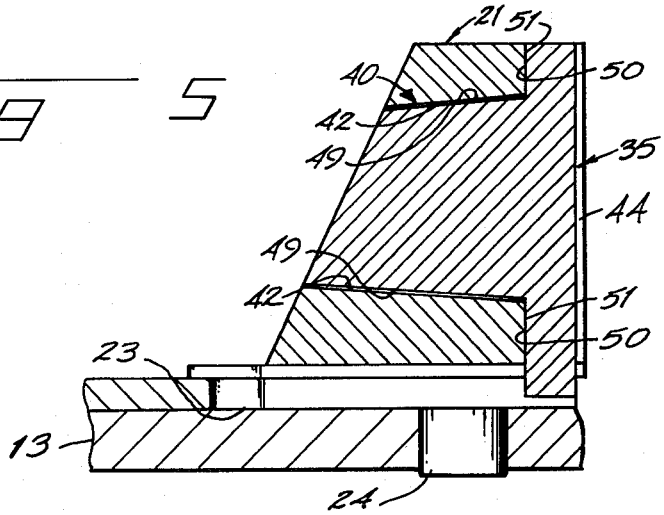
FIG. 5 is a cross-sectional view taken along line 5—5 in FIG. 2.
Figure 6:
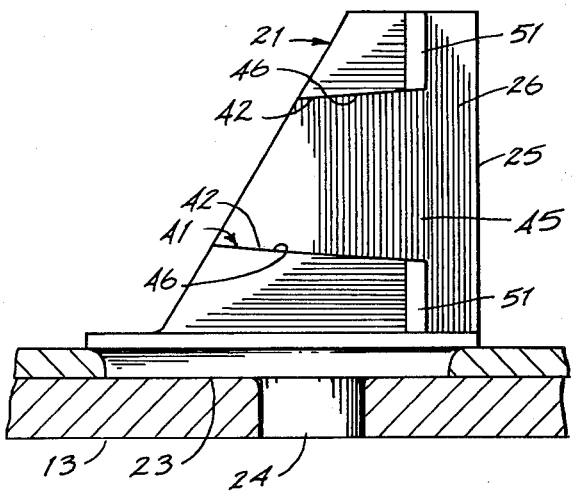
FIG. 6 is an end view of the present bracket with an associated wear protector plate removed.
Figure 7:
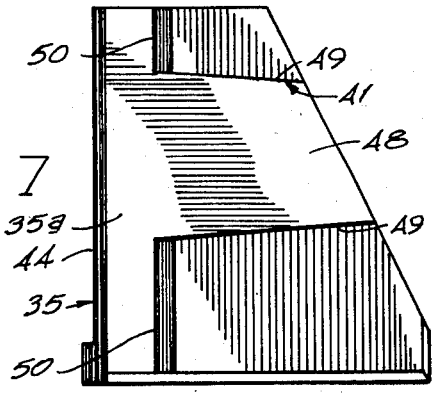
FIG. 7 is an elevation view of the inside surface of a wear protector plate.
Figure 8:
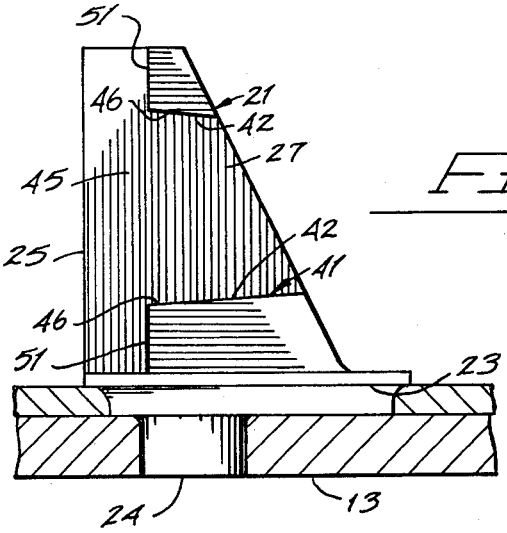
FIG. 8 is a view of the opposite bracket end with the remaining wear protector plate removed.
Figure 9:
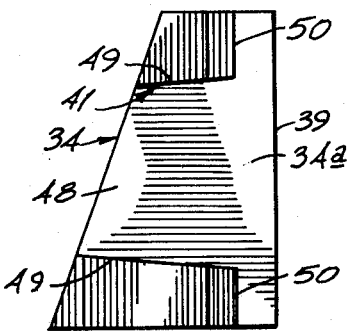
FIG. 9 is an elevation view of the inside surface of the remaining wear protector plate.

It is preferred that the dovetail connector members 41 be comprised of open grooves 42 formed integrally in both end faces 26 and 27 of the base members 21. The open grooves 42 are shaped, as shown in FIG. 5, in a female dovetail configuration. They lead rearwardly from front openings 45 on the front base member faces 25. Preferably, the grooves include sides 46 (FIGS. 4, 11) that taper or converge in a rearward direction.

The dovetail connector members 41 also include dovetail projections 48 preferably formed integrally on the wear protector plates 34, 35. The dovetail projections 48 are the male complements of the grooves 42. The projections include tapering sides 49 that converge rearwardly.

FIG. 5 shows the fit between a base member 21 and one of the outer plates 35. There it can be seen that the dovetail projection 48 fits securely within the associated groove 42.

FIG. 5 also shows abutment surfaces 50 on the wear protector plate 35 and opposed abutment surfaces 51 on the associated base member 21. Similar surfaces 50 and 51 are also provided on the remaining plate 34 and base at end 27. The surfaces 50 and 51 are positioned relative to the dovetail connector members 41 to prevent rearward sliding motion of the plates on the base member beyond positions wherein a gap would be formed between the back face 15 of the impeller shoe and the forward end faces 39,44 of the plates. Such a gap would allow particulate material to enter and otherwise cause undesirable wear along exposed surfaces of the base member 21 and could also bind the plates in position.

The abutment surfaces 51, 50 are simply comprised of upright flat surfaces formed integrally within the respective base members and plates on opposite sides of the corresponding integral dovetail grooves 42 and projections 48.

When the impeller shoes 11 are in proper position on the base members 21, the plate wear surfaces **34*a* and 35*a* will be either flush with the respective impeller shoe side edges or situated inwardly (toward the base member) therefrom. The plates 34, 35 are therefore effectively locked in position between the abutment surfaces 51 on the base members and the back faces 15 of the impeller shoes 11**.

Assembly of the wear protector plates 34, 35 and base members 21 is accomplished prior to mounting of the impeller shoes 11. This is done by simply moving the protector plates 34, 35 horizontally and in a rearward direction to slidably interfit the complementary dovetail connector members 41. The plates 34, 35 are moved rearwardly relative to the base members until the abutment surfaces 50 and 51 come into contact. This step is followed by mounting the impeller shoes. The impeller shoes are mounted by sliding the rearwardly projecting mounting studs 29 through the base member apertures 28. The pins 30 are then secured through the base members and studs to hold the impellers securely against the base members. The back faces 15 of the impeller shoes project beyond the faces 26 and 27 of the base members to overlap the forward end faces 39, 44 of the plates. These portions of the impeller shoes prevent forward movement of the plates 34, 35 thereby locking the plates 34, 35 into position on the base members.

During operation of the crushing machine, particulate material will be accelerated radially outward from the disk 14 against the impeller shoes 11. Some material will also strike against the inside wear protector plate 34 mounted to the inside end faces 27 of the base members. The wear surfaces 34*a* of plates 34, however, protect the principal body of the assembly (the base members) by withstanding the impact and submitting to wear from frictional engagement with the particulates. Similarly, the plates 35 situated along the outside end faces 26 of the base members are subjected to impact and frictional wear along their exposed wear surfaces 35*a* from particulate material rebounding in from the anvil assemblies. Plates 35 also protect the base members from the impact and wear.

The wear protector plates 34, 35 are easily removed and replaced after eventual wear. This process is accomplished first by removing the impeller shoes 11. The back faces 15 of the impeller shoes are thereby removed from engagement with the forward end faces 39, 44 of the plates 34, 35. The plates can then be moved forwardly, free of the base member 21. The abutment surfaces 50 and 51 prevent the dovetail connector members 41 from forcibly binding together during use. The plates therefore remain freely movable once the impeller shoes have been removed.

Replacement of the wear protector plates 34, 35 avoids wear along otherwise exposed surfaces of the base members 21. The wear plates can be replaced relatively easily and therefore eliminate the time consuming and very expensive job of replacing the entire bracket assembly.

The above description and attached drawings have been given by way of example to set forth a preferred form of the present invention. It is understood that various modifications and changes may be made therein by those skilled in the art of manufacture and design of crushing equipment.

Having thus described our invention, what we claim is:

1. In a vertical shaft impact crushing machine having:

a rotatable horizontal impeller turntable;

a removable elongated impeller shoe mounted on the turntable, said shoe having an elongated back mounting face extending along the length of the shoe between an inner end and an outer end;

an upright bracket member mountable to the turntable and having a front face and opposed side faces;

wherein the front face of the bracket member has a width that is less than the length of the impeller shoe to receive and mount the back surface of the impeller shoe, with the ends of the shoe extending beyond the side faces of the bracket member;

wherein the improvement comprises:

wear protector plates, each having a bearing face a wear face, and a forward end face; and means for releasably mounting the wear protector plates to the side faces of the bracket member with the inner and outer end of the impeller shoe overlapping the forward end faces of the wear protection plates to secure the wear protector plates in place when the crushing shoes are mounted to the shoe bracket.

2. In the vertical shaft impact crushing machine as claimed by claim 1 wherein said releasable mounting means is comprised of complementary dovetail connector members on the bracket member and wear protector plates, said connector members being slidably interfitted to releasably mount the wear protector plates to the base member.

3. In the vertical shaft impact crushing machine as claimed by claim 2 wherein the dovetail connector members interfit horizontally.

4. In the vertical shaft impact crushing machine as claimed by claim 2 wherein the dovetail connector members include open dovetail grooves formed in the opposed side faces of the bracket member and complementary dovetail projections formed on the inside faces of the wear protector plates.

5. In the vertical shaft impact crushing machine as claimed by claim 4 wherein the dovetail connector members slide horizontally together with the protector plates sliding rearwardly with respect to the bracket member.

6. In the vertical shaft impact crushing machine as claimed by claim 2 wherein the dovetail connector members converge rearwardly.

7. In the vertical shaft impact crushing machine as claimed by claim 2 wherein the dovetail connector members are integral with the base member and wear protector plates and wherein said members slide together horizontally; and further comprising complementary abutment surfaces on the bracket member and wear protector plates for preventing rearward sliding motion of the protector plates relative to the base member beyond positions wherein the forward end faces are substantially aligned with the front face of the bracket member.

8. In the vertical shaft impact crushing machine as claimed by claim 7 wherein the dovetail connector members converge rearwardly.

9. In the vertical shaft impact crushing machine as claimed by claim 8 wherein the dovetail connector members include open dovetail grooves formed in the opposed end faces of the bracket member and complementary dovetail projections formed on the bearing faces of the wear protector plates.

* * * * *